US006642911B2

(12) United States Patent
Shigeta et al.

(10) Patent No.: US 6,642,911 B2
(45) Date of Patent: Nov. 4, 2003

(54) PLASMA DISPLAY PANEL DRIVING METHOD

(75) Inventors: Tetsuya Shigeta, Nakakoma-gun (JP); Tetsuro Nagakubo, Nakakoma-gun (JP); Hirofumi Honda, Nakakoma-gun (JP)

(73) Assignee: Pioneer Corporation, Tokyo (JP)

( * ) Notice: Subject to any disclaimer, the term of this patent is extended or adjusted under 35 U.S.C. 154(b) by 29 days.

(21) Appl. No.: 09/842,208

(22) Filed: Apr. 26, 2001

(65) Prior Publication Data

US 2002/0018030 A1 Feb. 14, 2002

(30) Foreign Application Priority Data

Apr. 27, 2000 (JP) ..... 2000-127727

(51) Int. Cl.[7] ..... G09G 3/28
(52) U.S. Cl. ..... 345/60; 345/41; 345/690
(58) Field of Search ..... 345/60, 690, 694, 345/41; 315/169.4, 169.1

(56) References Cited

U.S. PATENT DOCUMENTS 6,292,159 B1 * 9/2001 Someya et al. ..... 345/60
6,417,824 B1 * 7/2002 Tokunaga et al. ..... 345/60
6,476,824 B1 * 11/2002 Suzuki et al. ..... 345/690
6,479,943 B2 * 11/2002 Shigeta et al. ..... 315/169.4

* cited by examiner

*Primary Examiner*—Steven Saras
*Assistant Examiner*—Fritz Alphonse
(74) *Attorney, Agent, or Firm*—Sughrue Mion, PLLC

(57) ABSTRACT

A plasma display panel driving method capable of improving the contrast while preventing spurious borders. Only in the first subfield, a writing discharge is selectively produced only in discharge cells except for those serving to display a luminance level "0" to initialize these discharge cells to a light emitting cell state. Then, only in one of the remaining subfields except for the first subfield, an erasure discharge is selectively produced in the discharge cells remaining in the light emitting cell state in accordance with pixel data, causing the discharge cells to transition to a non-light emitting cell state. Only the discharge cells remaining in the light emitting cell state are driven to emit light the number of light emissions allocated thereto corresponding to a weighting factor applied to the subfield.

4 Claims, 13 Drawing Sheets

FIG. 9

| GRADATION LEVEL | DATA CONVERSION TABLE FOR SECOND DATA CONVERTER CIRCUIT 34 | | | | | | | | | | | | | | | | LIGHT EMISSION DRIVING PATTERN IN ONE FIELD | | | | | | | | | | | | | | DISPLAY LUMINANCE |
|---|---|---|---|---|---|---|---|---|---|---|---|---|---|---|---|---|---|---|---|---|---|---|---|---|---|---|---|---|---|---|---|
| | PDs | GD | | | | | | | | | | | | | | | SF 1 | SF 2 | SF 3 | SF 4 | SF 5 | SF 6 | SF 7 | SF 8 | SF 9 | SF 10 | SF 11 | SF 12 | SF 13 | SF 14 | |
| | | 0 | 1 | 2 | 3 | 4 | 5 | 6 | 7 | 8 | 9 | 10 | 11 | 12 | 13 | 14 | | | | | | | | | | | | | | | |
| 1 | 0000 | 0 | 1 | 0 | 0 | 0 | 0 | 0 | 0 | 0 | 0 | 0 | 0 | 0 | 0 | 0 | | | | | | | | | | | | | | | 0 |
| 2 | 0001 | 1 | 0 | 1 | 0 | 0 | 0 | 0 | 0 | 0 | 0 | 0 | 0 | 0 | 0 | 0 | ◎ | ● | | | | | | | | | | | | | 1 |
| 3 | 0010 | 1 | 0 | 0 | 1 | 0 | 0 | 0 | 0 | 0 | 0 | 0 | 0 | 0 | 0 | 0 | ◎ | ○ | ● | | | | | | | | | | | | 4 |
| 4 | 0011 | 1 | 0 | 0 | 0 | 1 | 0 | 0 | 0 | 0 | 0 | 0 | 0 | 0 | 0 | 0 | ◎ | ○ | ○ | ● | | | | | | | | | | | 9 |
| 5 | 0100 | 1 | 0 | 0 | 0 | 0 | 1 | 0 | 0 | 0 | 0 | 0 | 0 | 0 | 0 | 0 | ◎ | ○ | ○ | ○ | ● | | | | | | | | | | 17 |
| 6 | 0101 | 1 | 0 | 0 | 0 | 0 | 0 | 1 | 0 | 0 | 0 | 0 | 0 | 0 | 0 | 0 | ◎ | ○ | ○ | ○ | ○ | ● | | | | | | | | | 27 |
| 7 | 0110 | 1 | 0 | 0 | 0 | 0 | 0 | 0 | 1 | 0 | 0 | 0 | 0 | 0 | 0 | 0 | ◎ | ○ | ○ | ○ | ○ | ○ | ● | | | | | | | | 40 |
| 8 | 0111 | 1 | 0 | 0 | 0 | 0 | 0 | 0 | 0 | 1 | 0 | 0 | 0 | 0 | 0 | 0 | ◎ | ○ | ○ | ○ | ○ | ○ | ○ | ● | | | | | | | 56 |
| 9 | 1000 | 1 | 0 | 0 | 0 | 0 | 0 | 0 | 0 | 0 | 1 | 0 | 0 | 0 | 0 | 0 | ◎ | ○ | ○ | ○ | ○ | ○ | ○ | ○ | ● | | | | | | 75 |
| 10 | 1001 | 1 | 0 | 0 | 0 | 0 | 0 | 0 | 0 | 0 | 0 | 1 | 0 | 0 | 0 | 0 | ◎ | ○ | ○ | ○ | ○ | ○ | ○ | ○ | ○ | ● | | | | | 97 |
| 11 | 1010 | 1 | 0 | 0 | 0 | 0 | 0 | 0 | 0 | 0 | 0 | 0 | 1 | 0 | 0 | 0 | ◎ | ○ | ○ | ○ | ○ | ○ | ○ | ○ | ○ | ○ | ● | | | | 122 |
| 12 | 1011 | 1 | 0 | 0 | 0 | 0 | 0 | 0 | 0 | 0 | 0 | 0 | 0 | 1 | 0 | 0 | ◎ | ○ | ○ | ○ | ○ | ○ | ○ | ○ | ○ | ○ | ○ | ● | | | 150 |
| 13 | 1100 | 1 | 0 | 0 | 0 | 0 | 0 | 0 | 0 | 0 | 0 | 0 | 0 | 0 | 1 | 0 | ◎ | ○ | ○ | ○ | ○ | ○ | ○ | ○ | ○ | ○ | ○ | ○ | ● | | 182 |
| 14 | 1101 | 1 | 0 | 0 | 0 | 0 | 0 | 0 | 0 | 0 | 0 | 0 | 0 | 0 | 0 | 1 | ◎ | ○ | ○ | ○ | ○ | ○ | ○ | ○ | ○ | ○ | ○ | ○ | ○ | ● | 217 |
| 15 | 1110 | 1 | 0 | 0 | 0 | 0 | 0 | 0 | 0 | 0 | 0 | 0 | 0 | 0 | 0 | 0 | ◎ | ○ | ○ | ○ | ○ | ○ | ○ | ○ | ○ | ○ | ○ | ○ | ○ | ○ | 255 |

◎ : SELECTIVE WRITING DISCHARGE + "LIGHT EMISSION"
○ : "LIGHT EMISSION"
● : SELECTIVE ERASURE DISCHARGE

FIG. 14

| GRADATION LEVEL | DATA CONVERSION TABLE FOR SECOND DATA CONVERTER CIRCUIT 34 | | | | | | | | | | | | | | | | LIGHT EMISSION DRIVING PATTERN IN ONE FIELD | | | | | | | | | | | | | | DISPLAY LUMINANCE |
|---|---|---|---|---|---|---|---|---|---|---|---|---|---|---|---|---|---|---|---|---|---|---|---|---|---|---|---|---|---|---|---|
| | PDs | GD | | | | | | | | | | | | | | | SF 1 | SF 2 | SF 3 | SF 4 | SF 5 | SF 6 | SF 7 | SF 8 | SF 9 | SF 10 | SF 11 | SF 12 | SF 13 | SF 14 | |
| | | 0 | 1 | 2 | 3 | 4 | 5 | 6 | 7 | 8 | 9 | 10 | 11 | 12 | 13 | 14 | | | | | | | | | | | | | | | |
| 1 | 0000 | 0 | 1 | 1 | 0 | 0 | 0 | 0 | 0 | 0 | 0 | 0 | 0 | 0 | 0 | 0 | | | | | | | | | | | | | | | 0 |
| 2 | 0001 | 1 | 0 | 1 | 1 | 0 | 0 | 0 | 0 | 0 | 0 | 0 | 0 | 0 | 0 | 0 | ◎ | ● | ● | | | | | | | | | | | | 1 |
| 3 | 0010 | 1 | 0 | 0 | 1 | 1 | 0 | 0 | 0 | 0 | 0 | 0 | 0 | 0 | 0 | 0 | ◎ | ○ | ● | ● | | | | | | | | | | | 4 |
| 4 | 0011 | 1 | 0 | 0 | 0 | 1 | 1 | 0 | 0 | 0 | 0 | 0 | 0 | 0 | 0 | 0 | ◎ | ○ | ○ | ● | ● | | | | | | | | | | 9 |
| 5 | 0100 | 1 | 0 | 0 | 0 | 0 | 1 | 1 | 0 | 0 | 0 | 0 | 0 | 0 | 0 | 0 | ◎ | ○ | ○ | ○ | ● | ● | | | | | | | | | 17 |
| 6 | 0101 | 1 | 0 | 0 | 0 | 0 | 0 | 1 | 1 | 0 | 0 | 0 | 0 | 0 | 0 | 0 | ◎ | ○ | ○ | ○ | ○ | ● | ● | | | | | | | | 27 |
| 7 | 0110 | 1 | 0 | 0 | 0 | 0 | 0 | 0 | 1 | 1 | 0 | 0 | 0 | 0 | 0 | 0 | ◎ | ○ | ○ | ○ | ○ | ○ | ● | ● | | | | | | | 40 |
| 8 | 0111 | 1 | 0 | 0 | 0 | 0 | 0 | 0 | 0 | 1 | 1 | 0 | 0 | 0 | 0 | 0 | ◎ | ○ | ○ | ○ | ○ | ○ | ○ | ● | ● | | | | | | 56 |
| 9 | 1000 | 1 | 0 | 0 | 0 | 0 | 0 | 0 | 0 | 0 | 1 | 1 | 0 | 0 | 0 | 0 | ◎ | ○ | ○ | ○ | ○ | ○ | ○ | ○ | ● | ● | | | | | 75 |
| 10 | 1001 | 1 | 0 | 0 | 0 | 0 | 0 | 0 | 0 | 0 | 0 | 1 | 1 | 0 | 0 | 0 | ◎ | ○ | ○ | ○ | ○ | ○ | ○ | ○ | ○ | ● | ● | | | | 97 |
| 11 | 1010 | 1 | 0 | 0 | 0 | 0 | 0 | 0 | 0 | 0 | 0 | 0 | 1 | 1 | 0 | 0 | ◎ | ○ | ○ | ○ | ○ | ○ | ○ | ○ | ○ | ○ | ● | ● | | | 122 |
| 12 | 1011 | 1 | 0 | 0 | 0 | 0 | 0 | 0 | 0 | 0 | 0 | 0 | 0 | 1 | 1 | 0 | ◎ | ○ | ○ | ○ | ○ | ○ | ○ | ○ | ○ | ○ | ○ | ● | ● | | 150 |
| 13 | 1100 | 1 | 0 | 0 | 0 | 0 | 0 | 0 | 0 | 0 | 0 | 0 | 0 | 0 | 1 | 1 | ◎ | ○ | ○ | ○ | ○ | ○ | ○ | ○ | ○ | ○ | ○ | ○ | ● | ● | 182 |
| 14 | 1101 | 1 | 0 | 0 | 0 | 0 | 0 | 0 | 0 | 0 | 0 | 0 | 0 | 0 | 0 | 1 | ◎ | ○ | ○ | ○ | ○ | ○ | ○ | ○ | ○ | ○ | ○ | ○ | ○ | ● | 217 |
| 15 | 1110 | 1 | 0 | 0 | 0 | 0 | 0 | 0 | 0 | 0 | 0 | 0 | 0 | 0 | 0 | 0 | ◎ | ○ | ○ | ○ | ○ | ○ | ○ | ○ | ○ | ○ | ○ | ○ | ○ | ○ | 255 |

◎ : SELECTIVE WRITING DISCHARGE + "LIGHT EMISSION"
○ : "LIGHT EMISSION"
● : SELECTIVE ERASURE DISCHARGE

PLASMA DISPLAY PANEL DRIVING METHOD

BACKGROUND OF THE INVENTION

1. Field of the Invention

The present invention relates to a method of driving a plasma display panel in accordance with a matrix display scheme.

2. Description of Related Art

At present, as thin display devices, AC (alternate current discharge) type plasma display panels are commercially available on the market. Since such plasma display panels utilize the discharge phenomenon to emit light, discharge cells only have two states, i.e., a "light emission" state corresponding to the highest luminance level and a "non-light emission" state corresponding to the lowest luminance level. Thus, a subfield method is employed to implement gradation driving for providing halftone display luminance levels corresponding to an input video signal. The subfield method involves constituting one field display period by N subfields in correspondence to each bit digit of N-bit pixel data corresponding to an input video signal. Then, a number of light emissions (light emitting period) is allocated to each of the N subfields corresponding to a weighting factor applied to each bit digit of the pixel data to selectively emit light in respective discharge cells in accordance with the pixel data bits.

For example, when one field display period is constituted by six subfields SF1–SF6 as shown in FIG. 1, each of the subfields is allocated the following number of light emissions:

SF1: 1

SF2: 2

SF3: 4

SF4: 8

SF5: 16

SF6: 32

In this case, when discharge cells are driven to emit light only in SF6 of the subfields SF1–SF6, light is emitted 32 times through one field display period, so that a display luminance at luminance level "32" is viewed. On the other hand, when discharge cells are driven to emit light in the subfields SF1–SF5 except for the subfield SF6, light is emitted a total of 31 times (16+8+4+2+1) through one field display period, so that a display luminance at luminance level "31" is viewed.

Stated another way, combinations of subfields in which discharge cells are driven to emit light enables a so-called 64-level gradation luminance display, in which 64 luminance levels can be provided in a stepwise manner.

Here, as shown in FIG. 1, a light emission driving pattern within one field period for driving a discharge cell to emit light at luminance level "32" is reverse to that for driving a discharge cell to emit light at luminance level "31." In other words, during one field period, a discharge cell which should be driven to emit light at luminance level "31" is in a non-light emitting state in a period in which a discharge cell which should be driven to emit light at luminance level "32" is emitting light, and the discharge cell which should be driven to emit light at luminance level "32" is in the non-light emitting state in a period in which a discharge cell which should be driven to emit light at luminance level "31" is emitting light. In this event, if the screen displays an image that includes a region in which a discharge cell which should be driven to emit light at luminance level "32" (hereinafter referred to as the "display region E32") and a discharge cell which should be driven to emit light at luminance level "31" (hereinafter referred to as the "display region E31") are located adjacent to each other, a trouble will arise as follows.

For example, when the line of sight is moved from the display region E32 to E31 immediately before a discharge cell existing in the display region E32 transitions from a non-light emitting state to a light emitting state, the non-light emitting state of both discharge cells are viewed in succession. As a result, a dark line is viewed on the boundary of both discharge cells. This dark line appears on the screen as a spurious border which is not at all related to any pixel data, thus resulting in a degraded display quality.

In addition, since the plasma display panel utilizes the discharge phenomena to implement the gradation driving based on the subfield method, this involves initialization of all discharge cells, setting of discharge cells to be driven for emitting light, and soon, as well as the light emission operation as described above. Therefore, the plasma display panel must conduct discharges not related to the contents of an image, giving rise to a problem that the contrast is degraded in the image by the light emission resulting from such discharges.

Further, a general consideration in commercializing such PDP at present is to realize lower power consumption.

OBJECT AND SUMMARY OF THE INVENTION

The present invention has been made to solve the problem mentioned above, and its object is to provide a plasma display panel driving method which is capable of improving the contrast with low power consumption while suppressing spurious borders.

A plasma display panel driving method according to the present invention drives a plasma display panel to display in gradation representation in accordance with a video signal. The plasma display panel has discharge cells, functioning as pixels, at intersections of a plurality of row electrodes corresponding to display lines with a plurality of column electrodes arranged to intersect the row electrodes. The method comprises the steps of selectively producing a writing discharge only in discharge cells except for discharge cells serving to display a luminance level "0" only in a first subfield of a plurality of subfields constituting one field display period in the video signal to initialize the discharge cells to a light emitting cell state; selectively producing an erasure discharge in the discharge cells remaining in the light emitting cell state in accordance with pixel data corresponding to the video signal only in one of the remaining subfields except for the first subfield to have the discharge cells transition to a non-light emitting cell state; and driving only the discharge cells in the light emitting cell state to emit light in each of the subfields the number of light emissions allocated thereto corresponding to a weighting factor applied to each of the subfields.

BRIEF DESCRIPTION OF THE INVENTION

FIG. 9 is a diagram showing a data conversion table in a second data converter circuit 34 and light emission driving patterns in one field display period;

Figure 12:
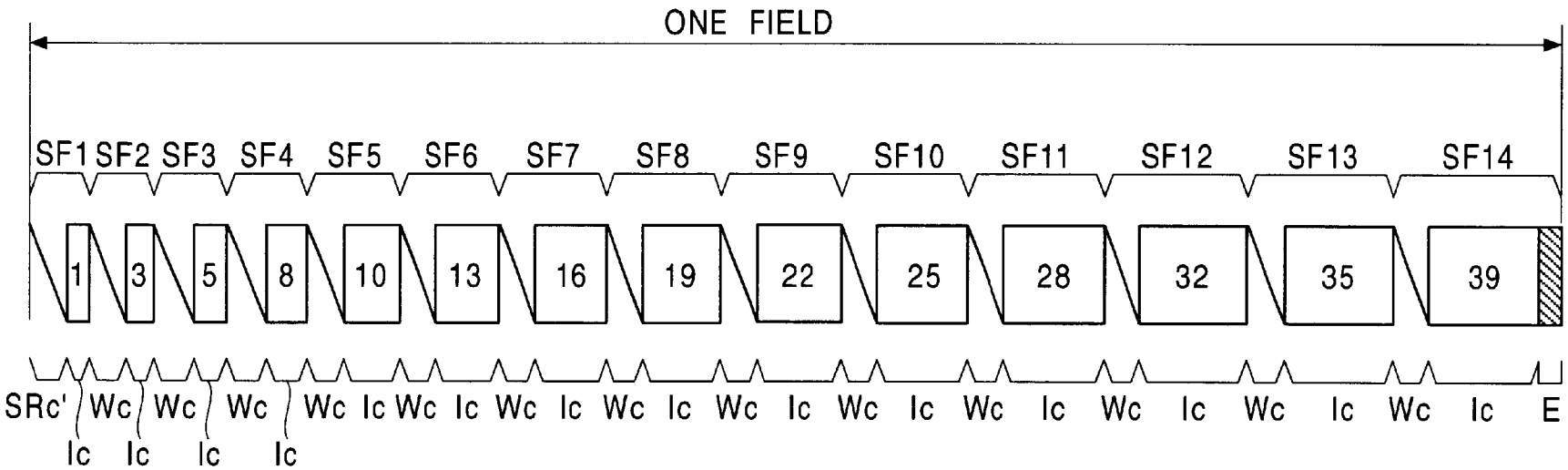
FIG. 12 is a diagram illustrating anther exemplary light emission driving format based on the driving method according to the present invention.
Figure 13:
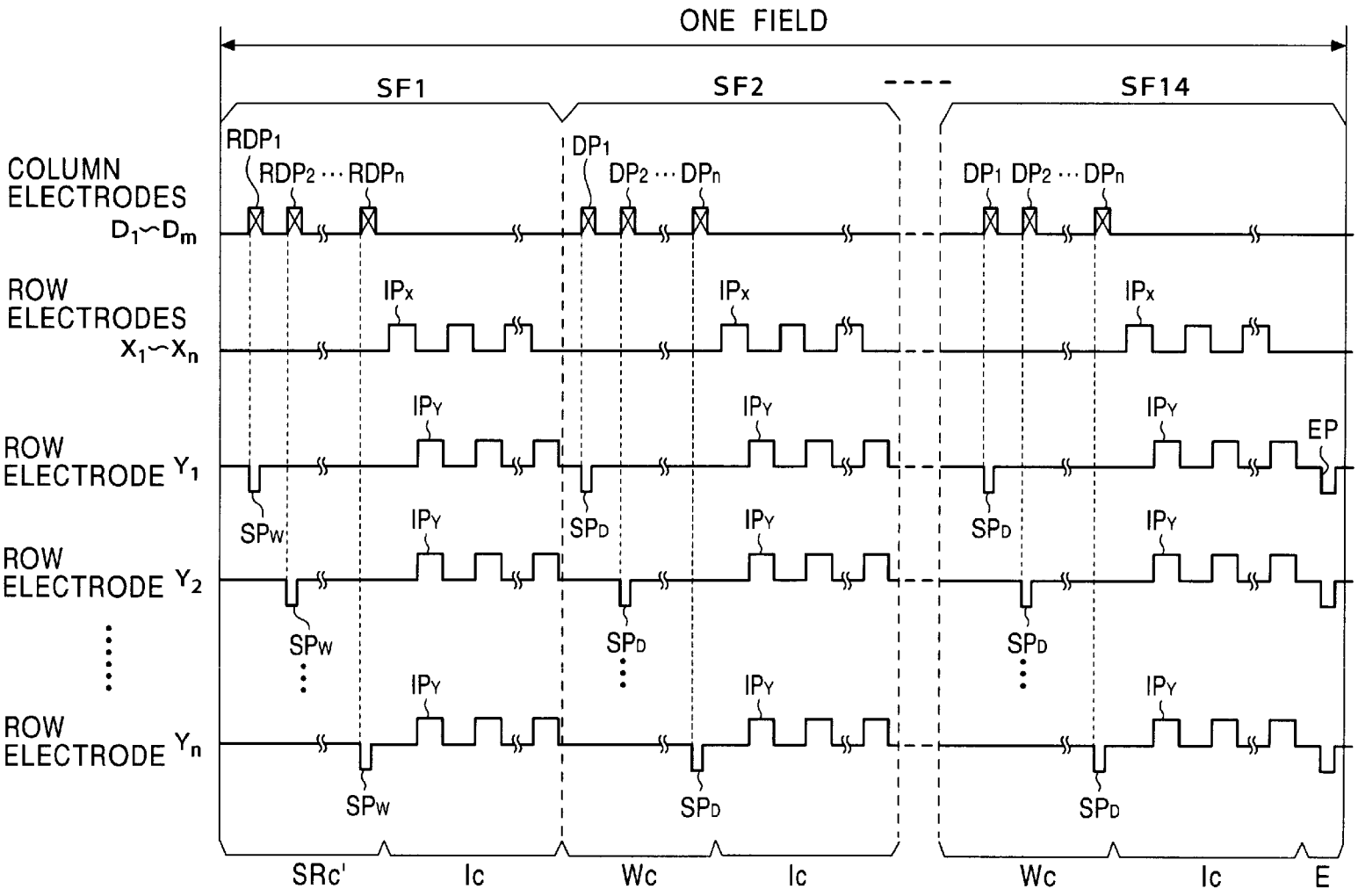

FIG. 13 is a waveform chart showing a variety of driving pulses applied to the PDP 10 in accordance with the light emission driving format illustrated in FIG. 12, and timings at which the driving pulses are applied; and FIG. 14 is a diagram showing a data conversion table employed in the second data converter circuit 34, and light emission driving patterns in one field display period for ensuring a pixel data writing operation.

DETAILED DESCRIPTION OF EMBODIMENTS

In the following, embodiments of the present invention will be described with reference to the accompanying drawings.

Figure 2:
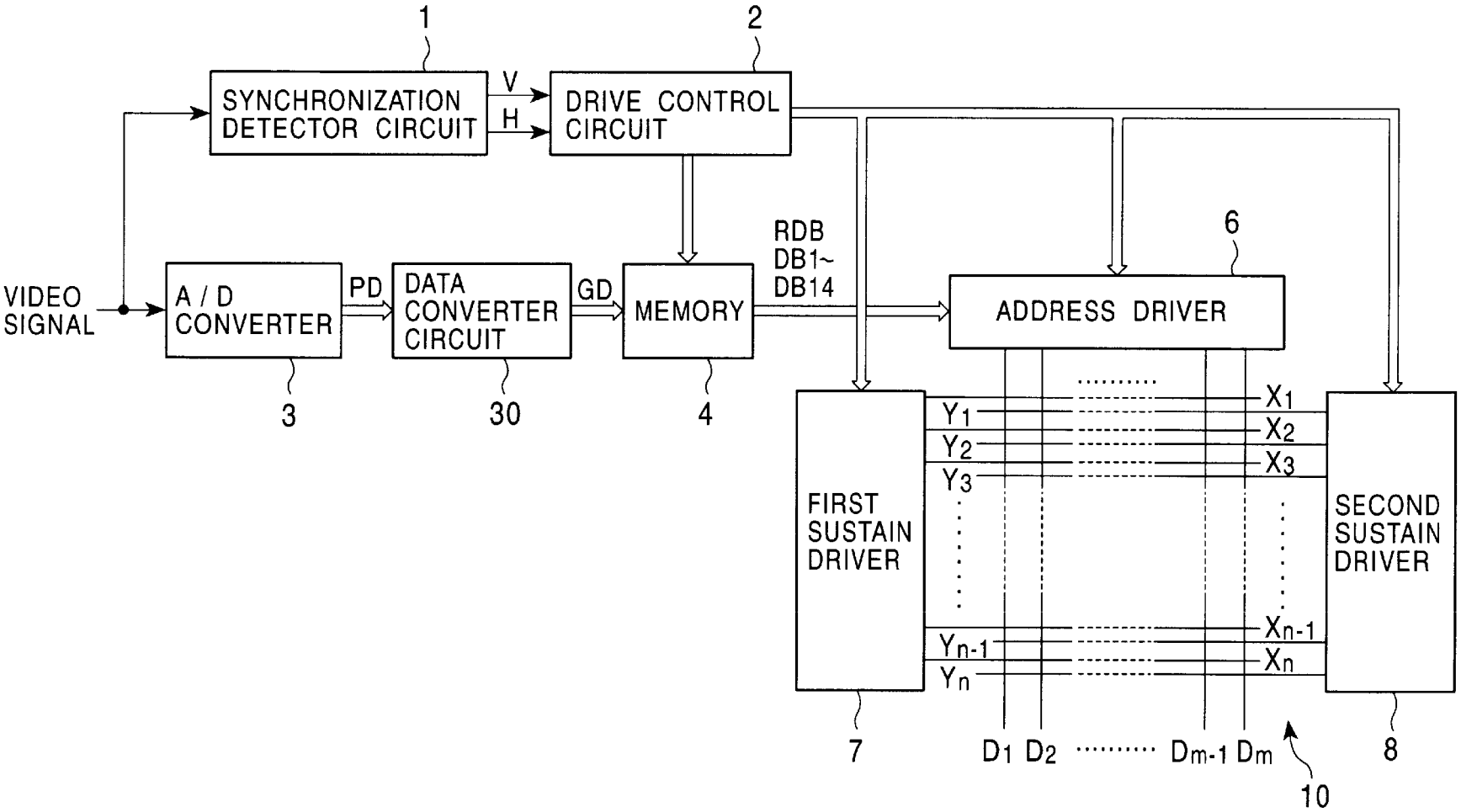
FIG. 2 is a block diagram generally illustrating the configuration of a plasma display device for driving a plasma display panel in accordance with a driving method according to the present invention.

FIG. 2 is a block diagram illustrating the configuration of a plasma display device which drives a plasma display panel in gradation representation in accordance with a driving method according to the present invention.

As illustrated in FIG. 2, the plasma display device comprises a PDP 10 as a plasma display panel, and a driving unit which is composed of a variety of functional modules as described below.

The PDP 10 comprises m column electrodes $D_1$–$D_m$ as address electrodes, and n row electrodes $X_1$–$X_n$ and row electrodes $Y_1$–$Y_n$ which are arranged to intersect these column electrodes, respectively. In the PDP 10, a row electrode for one line of the screen is formed of a pair of a row electrode X and a row electrode Y. A discharge space, in which a discharge gas is encapsulated, is formed between the row electrodes X, Y and the column electrode D, and a discharge cell that functions as a pixel is positioned at an intersection of each row electrode pair and a column electrode including the discharge space.

The driving unit comprises a synchronization detector circuit 1, a drive control circuit 2, an A/D converter 3, a data converter circuit 30, a memory 4, an address driver 6, a first sustain driver 7, and a second sustain driver 8.

A synchronization detector circuit 1 generates a vertical synchronization detecting signal V when it detects a vertical synchronization signal from an input video signal, and a horizontal synchronization detecting signal H when it detects a horizontal synchronization signal, and supplies these synchronization detecting signals to the drive control circuit 2. The A/D converter 3 samples and converts the input video signal to, for example, 8-bit pixel data PD on a pixel-by-pixel basis, and supplies the pixel data PD to the data converter circuit 30.

The data converter circuit 30 converts the 8-bit pixel data PD to 14-bit drive pixel data GD which is supplied to the memory 4.

Figure 3:
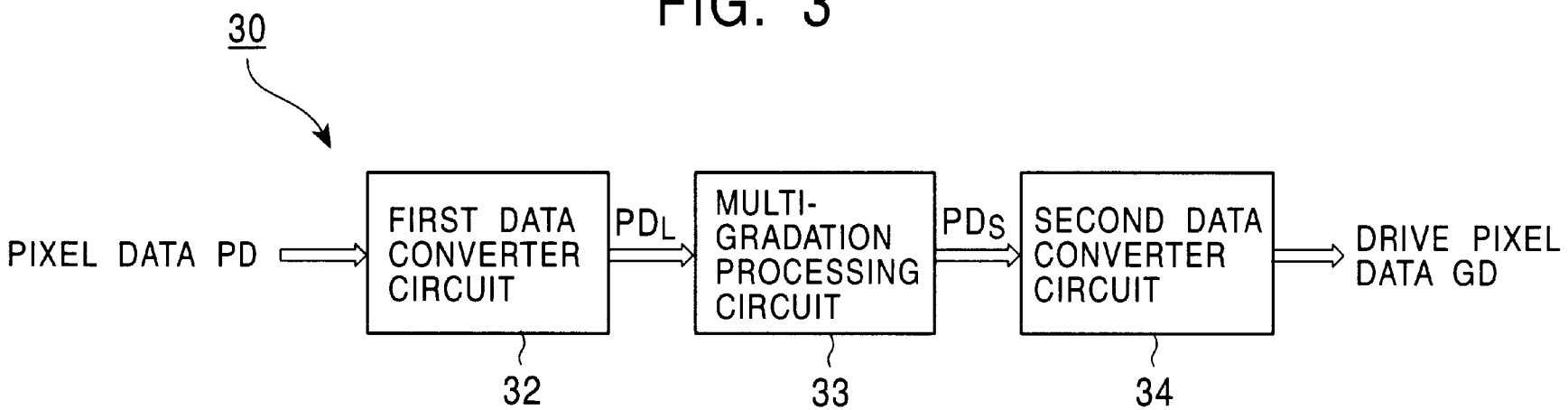
FIG. 3 is a block diagram illustrating the internal configuration of a data converter circuit 30.

FIG. 3 is a block diagram illustrating the internal configuration of the data converter circuit 30.

Figure 4:
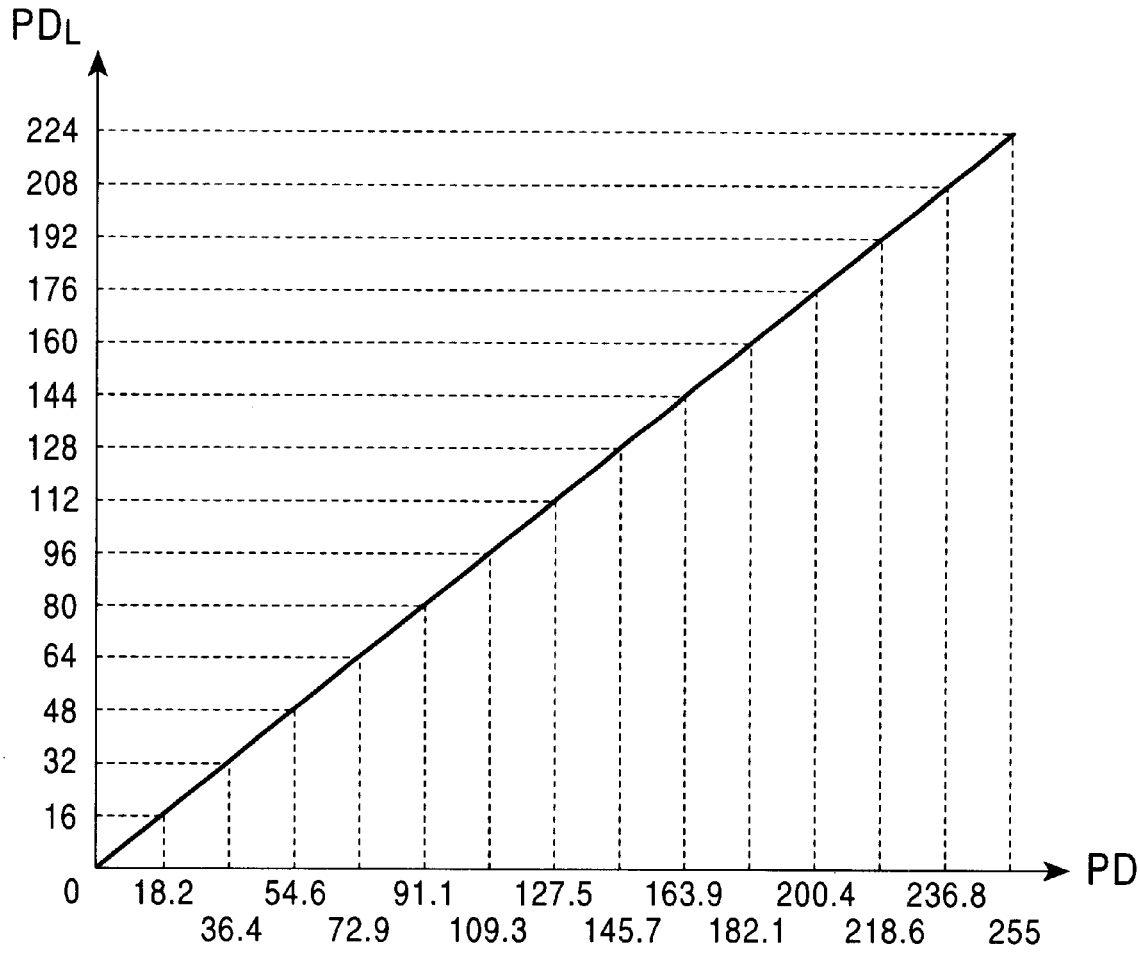
FIG. 4 is a graph showing a data conversion characteristic provided by a first data converter circuit 32.

In FIG. 3, a first data converter circuit 32 converts the 8-bit pixel data PD which is capable of representing luminance levels in a range of "0" to "255" to 8-bit luminance limited pixel data $PD_L$ in a luminance range of levels from "0" to "224" in accordance with a conversion characteristic as shown in FIG. 4, and supplies the luminance limited pixel data $PD_L$ to a multi-gradation processing circuit 33.

The multi-gradation processing circuit 33 applies multi-gradation processing such as error diffusion processing, dither processing and so on, which provides a bit compression in accordance with a luminance distribution, to the 8-bit luminance limited pixel data $DP_L$ to generate 4-bit multi-gradation processed pixel $PD_S$.

Figure 5:
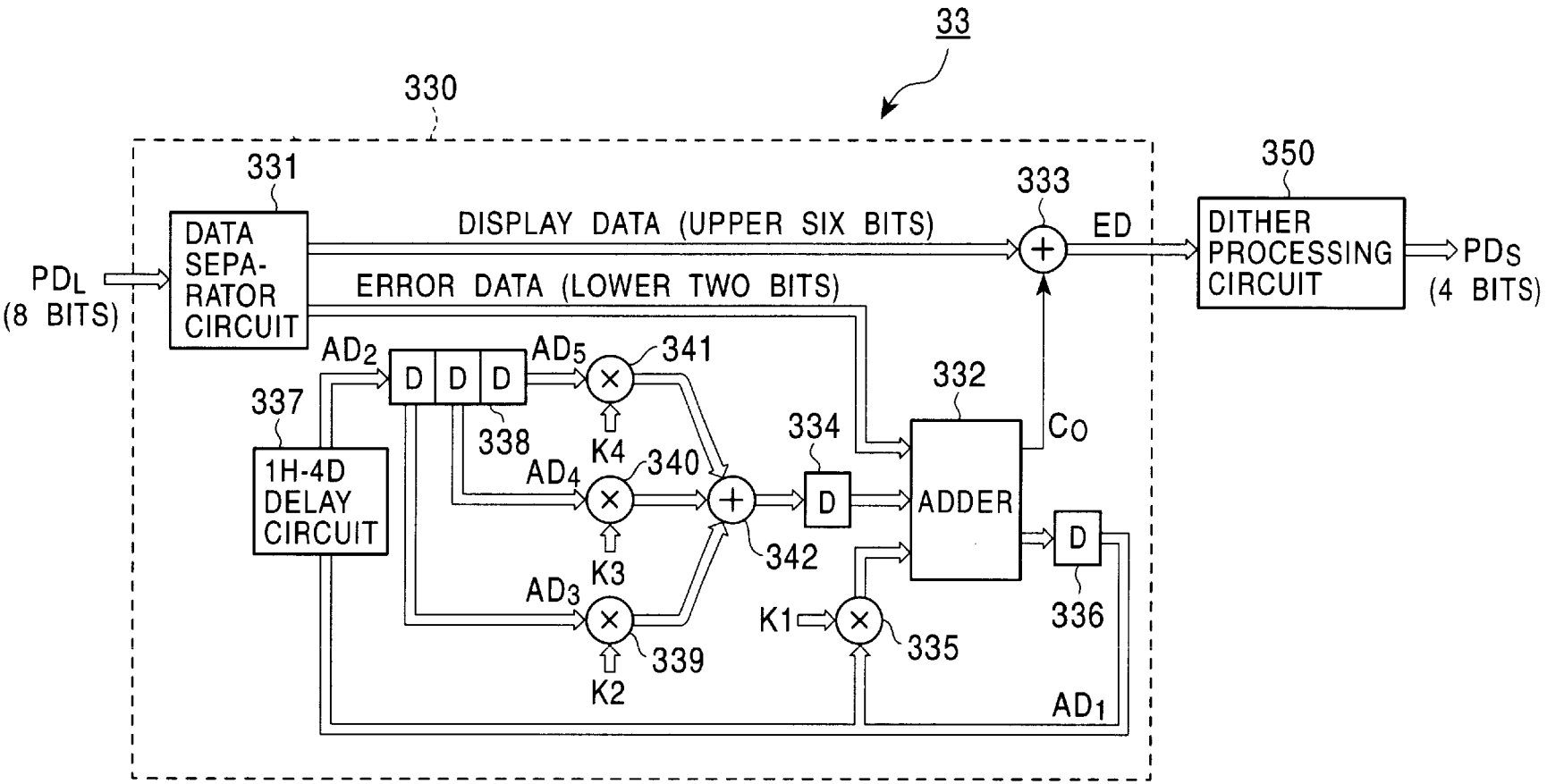
FIG. 5 is a block diagram illustrating the internal configuration of a multi-gradation processing circuit 33.

FIG. 5 is a block diagram illustrating the internal configuration of the multi-gradation processing circuit 33.

As illustrated in FIG. 5, the multi-gradation processing circuit 3 comprises an error diffusion processing circuit 330 and a dither processing circuit 350.

First, a data separator circuit 331 in the error diffusion processing circuit 330 separates the 8-bit luminance limited pixel data $PD_L$ supplied from the first data converter circuit 32 into lower two bits as error data and upper six bits as display data. An adder 332 adds the error data, a delay output from a delay circuit 334, and a multiplication output of a coefficient multiplier 335 to produce an addition value which is supplied to a delay circuit 336. The delay circuit 336 delays the addition value supplied from the adder 332 by a delay time D having the same time as a clock period of the pixel data PD to produce a delayed addition signal $AD_1$ which is supplied to the coefficient multiplying circuit 335 and to a delay circuit 337, respectively. The coefficient multiplier 335 multiplies the delayed addition signal $AD_1$ by a predetermined coefficient value $K_1$ (for example, "7/16"), and supplies the multiplication result to the adder 332. The delay circuit 337 again delays the delayed addition signal $AD_1$ by a time equal to (one horizontal scan period minus the delay time D multiplied by four) to produce a delayed addition signal $AD_2$ which is supplied to a delay circuit 338. The delay circuit 338 further delays the delayed addition signal $AD_2$ by the delay time D to produce a delayed addition signal $AD_3$ which is supplied to a coefficient multiplier 339. The delay circuit 338 further delays the delayed addition signal $AD_2$ by a time equal to the delay time D multiplied by two to produce a delayed addition signal $AD_4$ which is supplied to a coefficient multiplier 340. The delay circuit 338 further delays the delayed addition signal $AD_2$ by a time equal to the delay time D multiplied by three to produce a delayed addition signal $AD_5$ which is supplied to a coefficient multiplier 341. The coefficient multiplier 339 multiplies the delayed addition signal $AD_3$ by a predetermined coefficient value $K_2$ (for example, "3/16"), and supplies the multiplication result to an adder 342. The coefficient multiplier 340 multiplies the delayed addition signal $AD_4$ by a predetermined coefficient value $K_3$ (for example, "5/16"), and supplies the multiplication result to the adder 342. The coefficient multiplier 341 multiplies the delayed addition signal $AD_5$ by a predetermined coefficient value $K_4$ (for example, "1/16"), and supplies the multiplication result to the adder 342. The adder 342 adds the multiplication results supplied from the respective coefficient multipliers 339, 340, 341 to produce an addition signal which is supplied to the delay circuit 334. The delay circuit 334 delays the addition signal by the delay time D to produce a delayed signal which is supplied to the adder 332. The adder 332 adds the error data supplied from the data separator circuit 331, the delay output from the delay circuit 334, and the multiplication output from the coefficient multiplier 335, and generates a carry-out signal $C_O$ which is at logical level "0" when no carry is generated as a result of the addition, and at logical level "1" when a carry is generated. The carry-out signal $C_O$ is supplied to an adder 333. The adder 333 adds the carry-out signal $C_O$ to display data supplied from the data separator circuit 331 to output the 6-bit error diffusion processed pixel data ED.

The operation of the error diffusion processing circuit 330 configured as described above will be described below.

Figure 6:
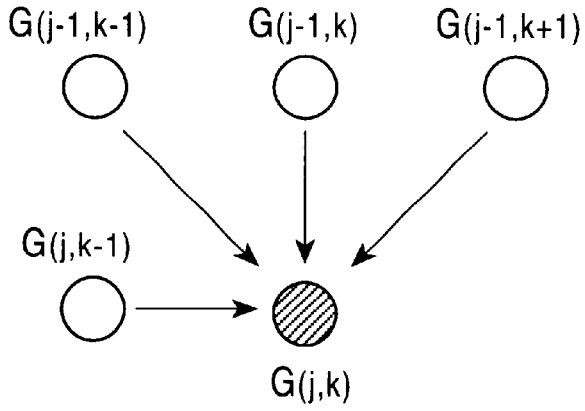
FIG. 6 is a diagram for explaining the operation of an error diffusion processing circuit 330.

For producing error diffusion processed pixel data ED corresponding to a pixel G(j, k) on the PDP 10, for example, as illustrated in FIG. 6, respective error data corresponding to a pixel G(j, k−1) on the left side of the pixel G(j, k), a pixel G(j−1, k−1) off to the upper left of the pixel G(j, k), a pixel G(j−1, k) above the pixel G(j, k), and a pixel G(j−1, k+1) off to the upper right of the pixel G(j, k), i.e.:

- error data corresponding to the pixel G(j, k−1): delayed addition signal $AD_1$;
- error data corresponding to the pixel G(j−1, k+1); delayed addition data $AD_3$;
- error data corresponding to the pixel G(j−1, k): delayed addition data $AD_4$; and
- error data corresponding to the pixel G(j−1, k−1): delayed addition data $AD_5$, are weighted with the predetermined coefficient values $K_1$–$K_4$, as mentioned above. Then, the weighted error data are added. Next, the lower two bits of the luminance limited pixel data $PD_L$, i.e., error data corresponding to the pixel G(j, k) is added to the addition result. Then, a 1-bit carry-out signal $C_O$ resulting from the addition is added to the upper six bits of the luminance limited pixel data $PD_L$, i.e., display data corresponding to the pixel G(j, k) to produce the error diffusion processed pixel data ED which is output from the error diffusion processing circuit 330.

With the configuration as described, the error diffusion processing circuit 330 regards the upper six bits of the luminance limited pixel data $PD_L$ as display data, and the remaining lower two bits as error data, and reflects the weighted addition of the error data at the respective peripheral pixels {G(j, k−1), G(j−1, k+1), G(j−1, k), G(j−1, k−1)} to the display data to produce the error diffusion processed pixel data ED. With this operation, the luminance for the lower two bits of the original pixel {G(j, k)} is virtually represented by the peripheral pixels, so that gradation representations of luminance equivalent to that provided by the 8-bit pixel data can be accomplished with display data having a number of bits less than eight bits, i.e., six bits. However, if the coefficient values for the error diffusion were constantly added to respective pixels, noise due to an error diffusion pattern could be visually recognized to cause a degraded image quality.

To eliminate this inconvenience, the coefficients $K_1$–$K_4$ for the error diffusion, which should be assigned to four pixels, may be changed from field to field in a manner similar to dither coefficients, later described.

The dither processing circuit 350 illustrated in FIG. 5 performs dither processing on the error diffusion processed pixel data ED supplied from the error diffusion processing circuit 330 to generate multi-level gradation processed pixel data $PD_S$ which has the number of bits reduced to 4 bits while maintaining the number of levels of luminance gradation which could be provided by 6-bit data. The dither processing used herein refers to a representation of an intermediate display level with a plurality of adjacent pixels. For example, for achieving a gradation display comparable to that available by eighth bits by using only upper six bits of 8-bit pixel data, four pixels vertically and horizontally adjacent to each other are grouped into one set, and four dither coefficients a–d having coefficient values different from each other are assigned to respective pixel data corresponding to the respective pixels in the set, and the resulting pixel data are added. In accordance with such dither processing, a combination of four different intermediate display levels can be produced with four pixels. Thus, for example, even if pixel data has six bits, an available number of levels of luminance gradation are four times as much. In other words, a half tone display comparable to that provided by eight bits can be achieved with six bits.

However, if a dither pattern formed of the dither coefficients a–d were constantly added to each pixel, noise due to the dither pattern could be visually recognized, thereby causing a degraded image quality.

To eliminate this inconvenience, the dither processing circuit 350 changes the dither coefficients a–d assigned to four pixels from field to field.

Figure 7:
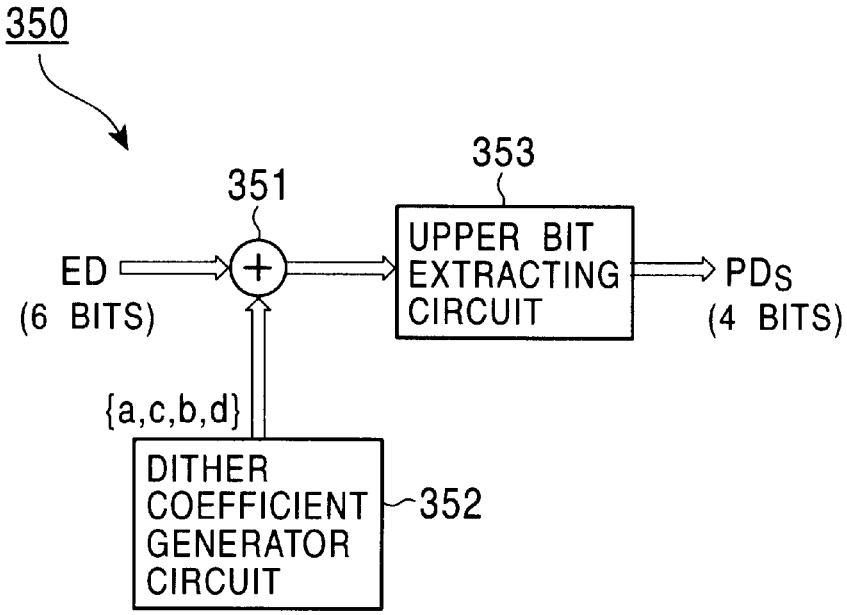
FIG. 7 is a block diagram illustrating the internal configuration of a dither processing circuit 350.

FIG. 7 is a block diagram illustrating the internal configuration of the dither processing circuit 350.

In FIG. 7, a dither coefficient generator circuit 352 generates four dither coefficients a, b, c, d for four mutually adjacent pixels, and supplies these dither coefficients sequentially to an adder 351.

Figure 8:
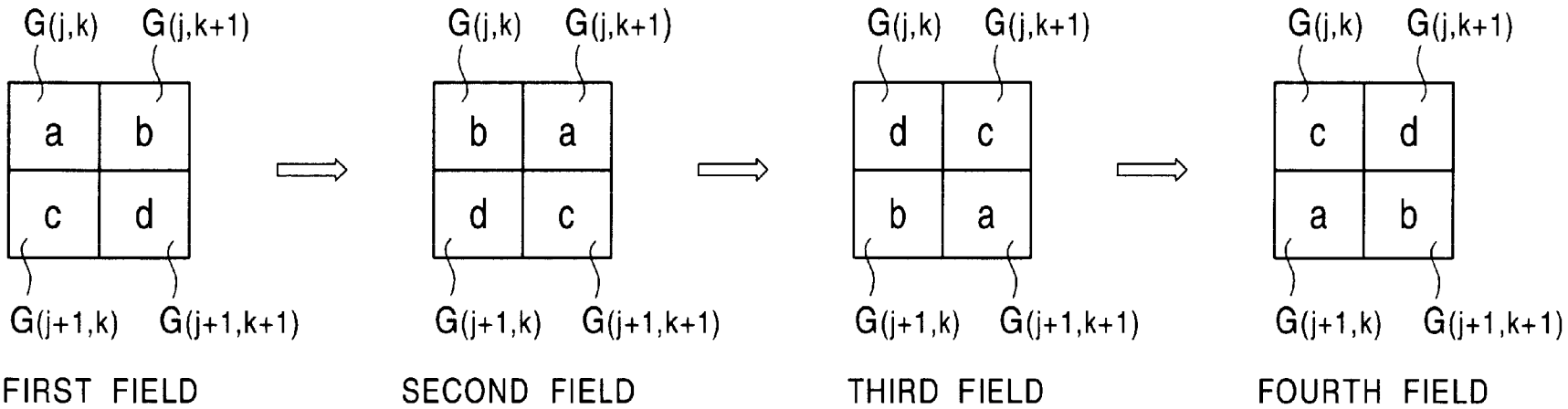
FIG. 8 is a diagram for explaining the operation of the dither processing circuit 350.

For example, as shown in FIG. 8, four dither coefficients a, b, c, d are generated corresponding to four pixels: a pixel G(j, k) and a pixel G(j, k+1) corresponding to a j-th row, and a pixel (j+1, k) and a pixel G(j+1, k+1) corresponding to a (j+1)th row, respectively. In this event, the dither coefficient generator circuit 352 changes the dither coefficients a–d assigned to these four pixels from field to field as shown in FIG. 8.

Specifically, the dither coefficient generator circuit 352 repeatedly generates the dither coefficients a–d in a cyclic manner with the following assignment:

in the first field:
- pixel G(j, k): dither coefficient a
- pixel G(j, k+1): dither coefficient b
- pixel G(j+1, k): dither coefficient c
- pixel G(j+1, k+1): dither coefficient d in the second field:
- pixel G(j, k): dither coefficient b
- pixel G(j, k+1): dither coefficient a
- pixel G(j+1, k): dither coefficient d
- pixel G(j+1, k+1): dither coefficient c in the third field:
- pixel G(j, k): dither coefficient d
- pixel G(j, k+1): dither coefficient c
- pixel G(j+1, k): dither coefficient b
- pixel G(j+1, k+1): dither coefficient a in the fourth field:
- pixel G(j, k): dither coefficient c
- pixel G(j, k+1): dither coefficient d
- pixel G(j+1, k): dither coefficient a
- pixel G(j+1, k+1): dither coefficient b Then, the dither coefficient generator circuit 352 repeatedly executes the operation in the first to fourth fields as described above. In other words, upon completion of the dither coefficient generating operation in the fourth field, the dither coefficient generator circuit 352 again returns to the operation in the first field to repeat the foregoing operation.

The adder 351 adds the dither coefficients a–d to the error diffusion processed pixel data ED, respectively, supplied thereto from the error diffusion processing circuit 330, corresponding to the pixels G(j, k), G(j, k+1), G(j+1, k), G(j+1, k+1), to produce dither added pixel data which is supplied to an upper bit extracting circuit 353.

For example, in the first field shown in FIG. 8, the adder 351 sequentially supplies:

- the error diffusion processed pixel data ED corresponding to the pixel G(j, k) plus the dither coefficient a;
- the error diffusion processed pixel data ED corresponding to the pixel G(j, k+1) plus the dither coefficient b;
- the error diffusion processed pixel data ED corresponding to the pixel G(j+1, k) plus the dither coefficient c; and
- the error diffusion processed pixel data ED corresponding to the pixel G(j+1, k+1) plus the dither coefficient d, to the upper bit extracting circuit 353 as the dither added pixel data.

The upper bit extracting circuit 353 extracts upper four bits of the dither added pixel data, and supplies the extracted bits to the second data converter circuit 34 illustrated in FIG. 3 as multi-level gradation processed pixel data $PD_S$.

The second data converter circuit 34 converts the multi-level gradation processed pixel data $PD_S$ to converted pixel data GD consisting of zero-th to fourteenth bits in accordance with a conversion table shown in FIG. 9.

The drive pixel data GD are sequentially written into the memory 4 in response to a write signal supplied from the driving control circuit 2. Once the drive pixel data for one screen, i.e., (nxm) drive pixel data $GD_{11}$–$GD_{nm}$ corresponding to respective pixels from the first row, first column to the n-th row, n-th column have been written into the memory 4, the memory 4 performs a reading operation as follows.

First, the memory 4 regards the zero-th bits of the respective drive pixel data $GD_{11}$–$GD_{nm}$ as initialization data bits $RDB_{11}$–$RDB_{nm}$, and reads them for each display line and supplies them to the address driver 6.

Next, the memory 4 regards the first bits of the respective drive pixel data $GD_{11}$–$GD_{nm}$ as initialization data bits $DB1_{11}$–$DB1_{nm}$, and reads them for each display line and supplies them to the address driver 6. Next, the memory 4 regards the second bits of the respective drive pixel data $GD_{11}$–$GD_{nm}$ as initialization data bit $DB2_{11}$–$DB2_{nm}$, and reads them for each display line and supplies them to the address driver 6. Next, the memory 4 regards the third bits of the respective drive pixel data $GD_{11}$–$GD_{nm}$ as initialization data bits $DB3_{11}$–$DB3_{nm}$, and reads them for each display line and supplies them to the address driver 6. Subsequently, in a similar manner, the memory 4 reads the fourth bits to the fourteenth bits of the respective drive pixel data $GD_{11}$–$GD_{nm}$ as drive pixel data bit DB3–DB14, and reads them for each display line and supplies them to the address driver 6.

Figure 10:
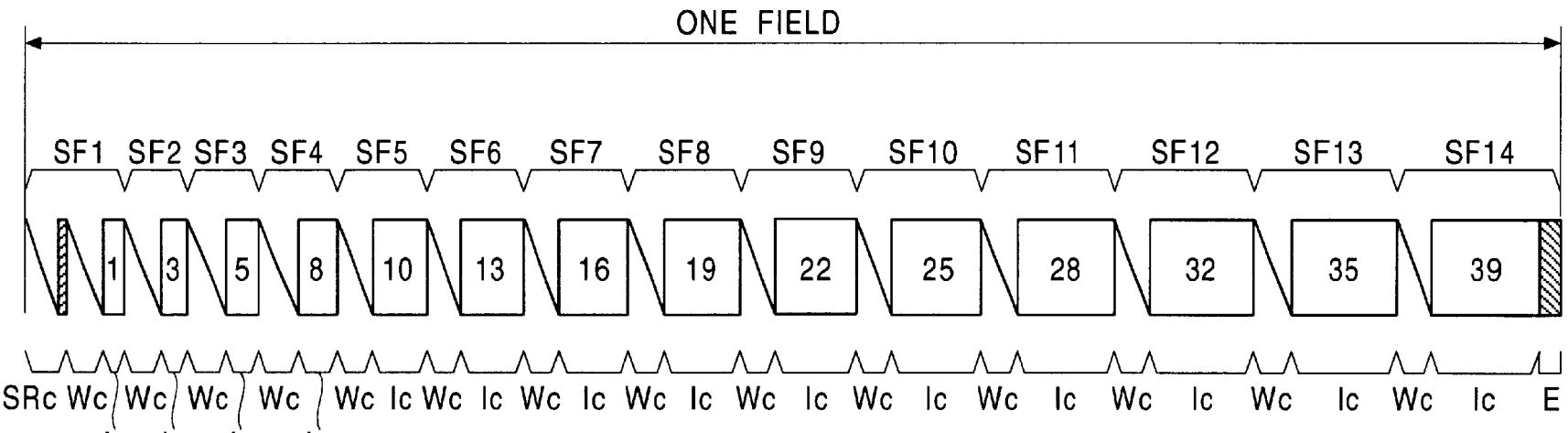
FIG. 10 is a diagram illustrating an exemplary light emission driving format based on a driving method according to the present invention.

The drive control circuit 2 generates a variety of timing signals for driving the PDP 10 to provide a gradation display in accordance with a light emission driving format as illustrated in FIG. 10, and supplies these timing signals to each of the address driver 6, first sustain driver 7 and second sustain driver 8.

In the light emission driving format illustrated in FIG. 10, one field display period is constituted by 14 subfields SF1–SF14, and a pixel data writing process Wc and a light emission sustain process Ic are performed respectively in each of the subfields. Further, a selective initialization process SRc is performed only in the first subfield SF1, and an erasure process E is performed only in the last subfield SF14. In this event, the light emission driving format illustrated in FIG. 10 employs a selective erasure address method as a pixel data writing method in each pixel data writing process Wc.

Figure 11:
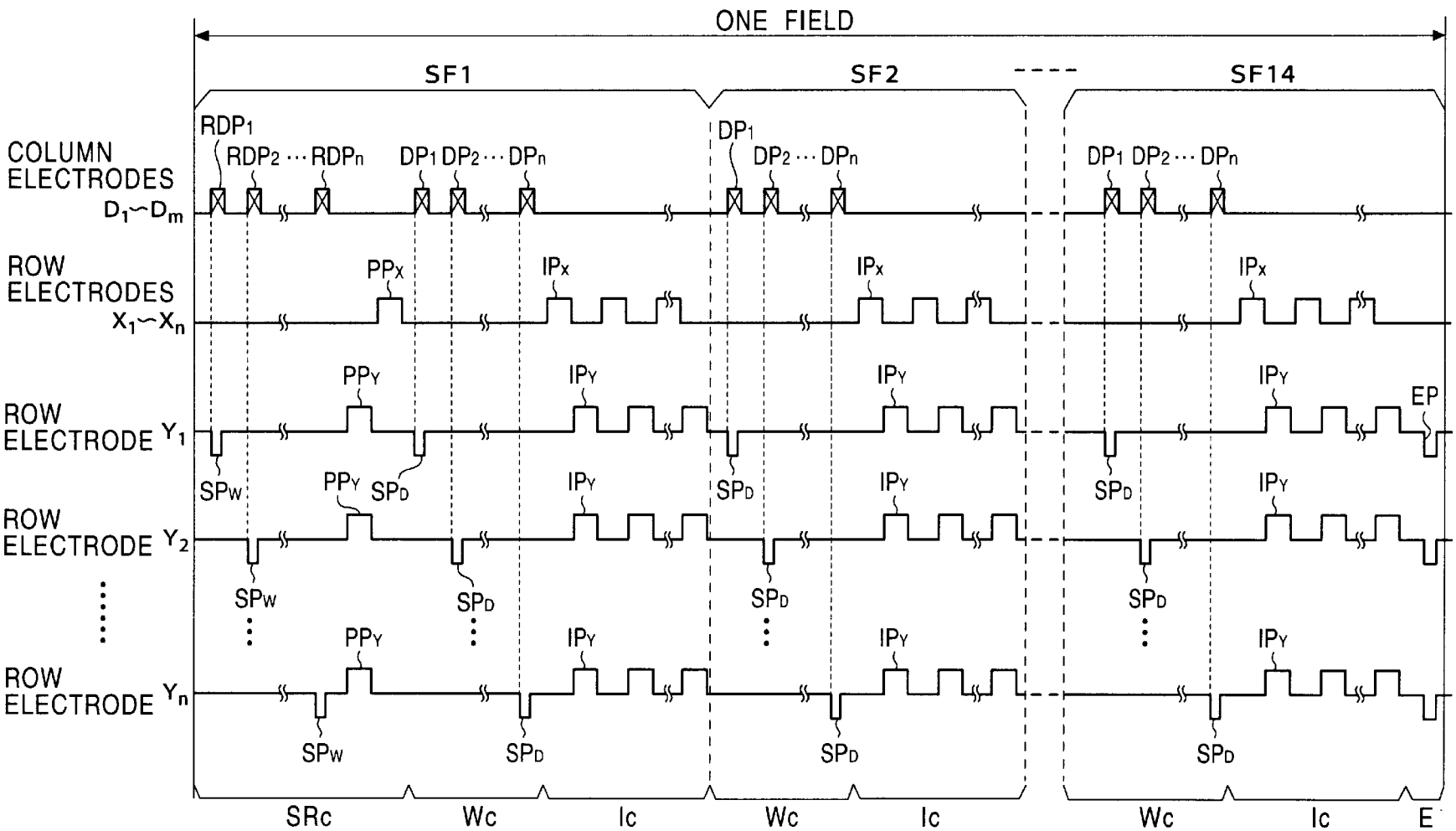
FIG. 11 is a waveform chart showing a variety of driving pulses applied to a PDP 10 in accordance with the light emission driving format illustrated in FIG. 10, and timings at which the driving pulses are applied.

FIG. 11 is a waveform chart showing a variety of driving pulses applied by each of the address driver 6, first sustain driver 7 and second sustain driver 8 to the PDP 10 in accordance with the light emission driving format illustrated in FIG. 10, and timings at which the driving pulses are applied.

In FIG. 11, in the selective initialization process SRc which is performed only in the subfield SF1, the address driver 6 generates an initialization data pulse having a pulse voltage corresponding to each of the initialization data bits $RDB_{11}RDB_{nm}$ read from the memory 4. For example, the address driver 6 generates the initialization data pulse at a high voltage when the initialization data bit RDB is at logical level "1" and at a low voltage (zero volt) when the initialization data bit RDB is at logical level "0." Then, the address driver 6 groups the initialization data pulses for each display line into initialization data pulse groups $RDP_1$–$RDP_n$ which are sequentially applied to the column electrodes $D_1$–$D_m$ of the PDP 10, as illustrated in FIG. 10. Further, in the selective initialization process SRc, the second sustain driver 8 generates a scanning pulse $SP_W$ of negative polarity at the same timing at which each of the initialization data pulse groups $RDP_1$–$RDP_n$ is applied, and sequentially applies the scanning pulse $SP_W$ to the row electrodes $Y_1$–$Y_n$, as shown in FIG. 11.

In this event, a writing discharge is produced only in discharge cells at intersections of display lines applied with the scanning pulse $SP_W$ with "columns" applied with the initialization data pulse at the high voltage, and charged particles are generated within the discharge space of each discharge cell. Then, after the end of the writing discharge, wall charges are formed in the discharge cells, so that the discharge cells are initialized to a "light emitting cell" state. On the other hand, the writing discharge as described above is not produced in discharge cells which have been applied with the initialization data pulse at the low voltage even with the scanning pulse $SP_W$ applied thereto. Therefore, no wall charges are formed in these discharge cells, thereby causing the discharge cells to remain in a "non-light emitting cell" state.

After the scanning pulse $SP_W$ has been applied to the row electrode $Y_n$, the second sustain driver 8 simultaneously applies each of the row electrodes $Y_1$–$Y_n$ with a priming pulse $PP_Y$ of positive polarity as shown in FIG. 11. Subsequently, the first sustain driver 7 simultaneously applies each of the row electrodes $Y_1$–$Y_n$ with a priming pulse $PP_X$ of positive polarity as shown in FIG. 11. The application of the priming pulse $PP_Y$ and the priming pulse $PP_X$ causes a priming discharge to be produced twice only in discharge cells, in which the wall charges remain, wall charges are again formed after the end of the discharge. In other words, the priming discharge is produced only in discharge cells in which the writing discharge has been produced, as described above, to form again the charged particles which had been formed by the writing discharge but has been reduced over time.

Here, whether or not the writing discharge is produced depends on the logical level of the zero-th bit of the drive pixel data GD shown in FIG. 9. The zero-th bit of the drive pixel data GD is at logical level "0" when the multi-gradation processed pixel data $PD_S$ is "0000," i.e., indicative of a luminance level "0" and at logical level "1" when $PD_S$ indicates a luminance level other than the luminance level "0." Then, the writing discharge is produced as long as the zero-th bit of the drive pixel data GD is at logical level "1," while any discharge is not produced when the zero-th bit is at logical level "0."

Therefore, with the selective initialization process SRc thus performed, the wall charge resulting from the writing discharge is produced in each of discharge cells corresponding to pixel data indicative of luminance levels other than luminance level "0" so that the discharge cells are initialized to the "light emitting cell" state. On the other hand, since no discharge occurs in each of discharge cells corresponding to pixel data indicative of luminance level "0," the wall charge as described is not either formed, so that these discharge cells remains in the "non-light emitting cell" state. In other words, since discharge cells need not essentially be driven to emit light for displaying luminance level "0," the writing discharge for initializing to the "light emitting cell" state is not produced in these discharge cells.

Next, in a pixel data writing process Wc performed in each subfield, the address driver 6 generates a pixel data pulse having a pulse voltage in accordance with a drive pixel data bit DB supplied from the memory 4. For example, the address driver 6 generates a pixel data pulse at a high voltage when the drive pixel data pulse DB is at logical level "1" and a pixel data pulse at a low voltage (zero volt) when the drive pixel data pulse DB is at logical level "0." Then, the address driver 6 groups the pixel data pulses into pixel data pulse groups DP for each display line, and sequentially applies the pixel data pulse groups DP to the column electrodes $D_1$–$D_m$.

Here, in the pixel data writing process Wc of the subfield SF1, each of the drive pixel data bits $DB1_1$–$DB_{nm}$ is sequentially read every display line from the memory 4. Therefore, during this reading, the address driver 6 sequentially applies the column electrodes $D_1$–$D_m$ with pixel data pulse groups $DP_1$, $DP_2$, $DP_3$, . . . , $DP_n$ generated based on the drive pixel data bits $DB1_{11}$–$DB1_{nm}$ every display line as shown in FIG. 11. Then, in the pixel data writing process Wc of the subfield SF2, each of the drive pixel data bits $DB2_{11}$–$DB2_{nm}$ is sequentially read every display line from the memory 4. Therefore, during this reading, the address driver 6 sequentially applies the column electrodes $D_1$–$D_m$ with pixel data pulse groups $DP_1$, $DP_2$, $DP_3$, . . . . , $DP_n$ generated based on the drive pixel data bits $DB2_{11}$–$DB2_{nm}$ every display line as shown in FIG. 11. Subsequently, in a similar manner, in the pixel data writing process Wc of each of the subfields SF3–SF14, the address driver 6 sequentially applies the column electrodes $D_1$–$D_m$ with pixel data pulse groups $DP_1$, $DP_2$, $DP_3$, . . . , $DP_n$, for every display line, generated based on each of drive pixel data bits DB3–DB14 read from the memory 4.

Further, in the pixel data writing process Wc, the second sustain driver 8 generates a scanning pulse $SP_D$ of negative polarity at the same timing at which each of the pixel data pulse groups $DP_1$, $DP_2$, $DP_3$, . . . , $DP_n$ is applied. Then, as shown in FIG. 11, the scanning pulse $SP_D$ is sequentially applied to the row electrodes $X_1$–$X_n$.

In the pixel data writing process Wc, a discharge (selective erasure discharge) occurs only in discharge cells at intersections of display lines applied with the scanning pulse $SP_D$ with "columns" applied with the pixel data pulse of the high voltage. The selective erasure discharge causes the wall charges formed in the discharge cells to extinguish, so that the discharge cells transition to a "non-light emitting cell" state. On the other hand, the selective erasure discharge is not produced in discharge cells which have been applied with the pixel data pulse at the low voltage even with the scanning pulse $SP_D$ applied thereto, so that these discharge cells remain in the state initialized in the selective initialization process SRc, i.e., the "light emitting cell" state.

In other words, with the pixel data writing process Wc, so-called pixel data writing is performed, wherein each of the discharge cells is set to the "light emitting cell" or to the "non-light emitting cell" state in accordance with pixel data of each pixel corresponding to an input video signal.

Next, in a light emission sustain process Ic in each subfield, each of the first sustain driver 7 and the second sustain driver 8 alternately applies the row electrodes $X_1$–$X_n$, $Y_1$–$Y_n$ with sustain pulses $IP_X$, $IP_Y$ of positive polarity in repetition, as shown in FIG. 11. In this event, the number of times the sustain pulses should be applied in each light emission sustain process Ic differs depending on a weighting factor applied to a gradation luminance of each subfield. For example, assuming that the number of light emissions (two based on the priming pulses $PP_X$, $PP_Y$ plus the number of sustain pulses IP applied in the light emission sustain process Ic of SF1) is "1" in the subfield SF1, the number of light emissions in the light emission sustain process Ic of each subfield is as follow:

SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

The light emission sustain process Ic thus performed causes only discharge cells in which the wall charges remain, i.e., the "light emitting cells" to discharge for sustaining the light each time the sustain pulses $IP_X$, $IP_Y$ are applied thereto. Thus, the light emitting cells repeat the light emission resulting from the sustain discharges the number of times (period) as mentioned above.

Next, in the erasure process E performed only in the last subfield SF14 within one field display period, the second sustain driver 8 applies the row electrodes $Y_1$–$Y_n$ with a erasure pulse EP as shown in FIG. 11, to simultaneously produce discharges in all the discharge cells for erasure. This results in complete extinction of the wall charges which have been remained in the respective discharge cells.

With the operation as described above, a display luminance corresponding to the total number of light emissions performed in the light emission sustain process Ic of each of the subfields SF in one field display period appears on the screen of the PDP 10.

Figure 1:
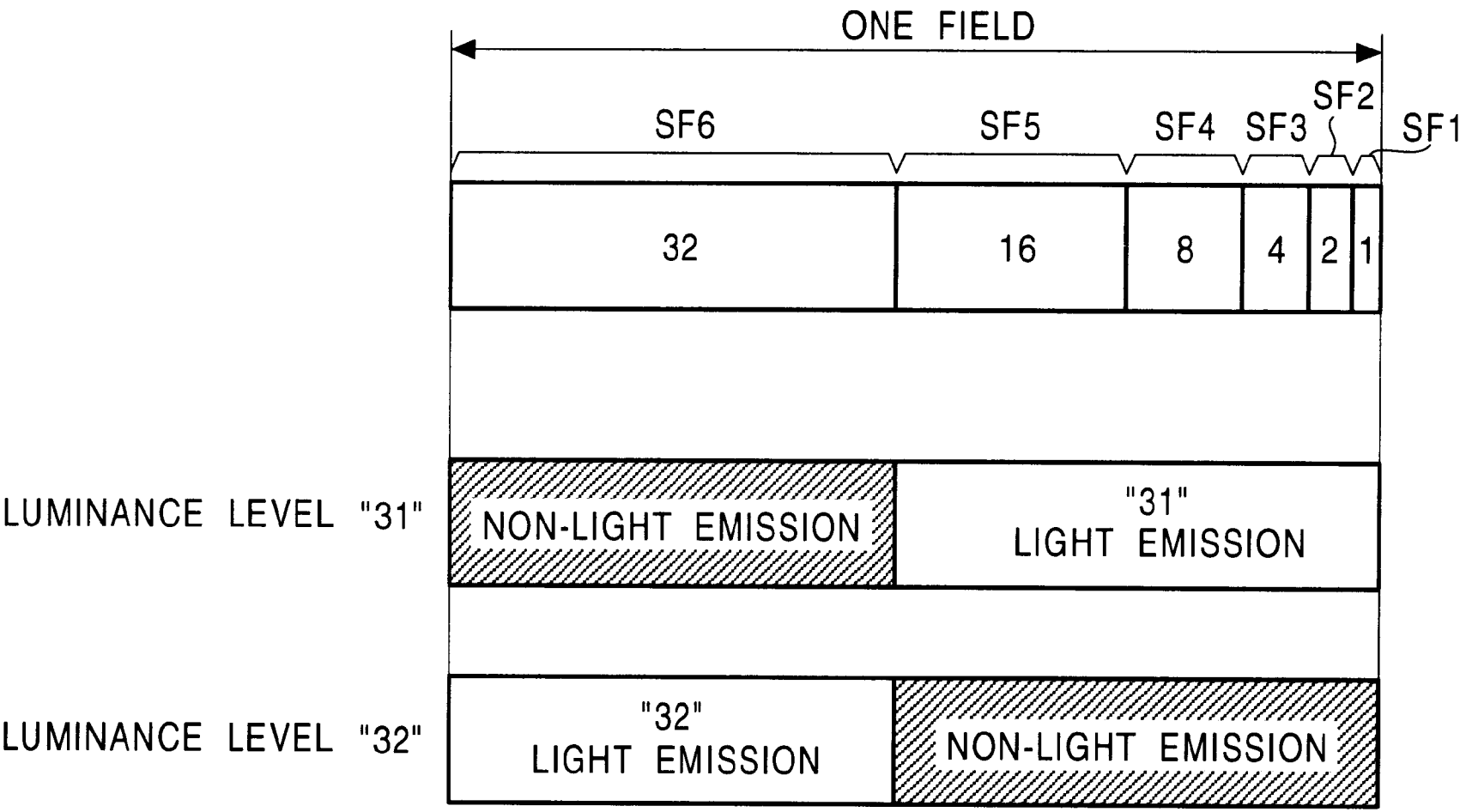
FIG. 1 is a diagram for explaining the operation involved in conventional luminance gradation driving based on a subfield method.

It should be noted that whether or not the sustain discharge as described above is produced in the light emission sustain process Ic in each subfield is determined depending on whether or not the selective erasure discharge is produced in the pixel data writing process Wc in the subfield. Here, according to a bit pattern of the drive pixel data GD as shown in FIG. 9, the selective erasure discharge is produced in the pixel data writing process Wc of only one subfield at most within one field display period, as indicated by black circles in the figure. Therefore, the wall charges formed in the selective initialization process SRc of the first subfield SF1 remain until the selective erasure discharge is produced, so that each discharge cell remains in the "light emitting cell" state. Consequently, light is emitted successively in each light emission sustain process Ic of each of subfields (indicated by white circles) intervening therebetween. In this event, as shown in FIG. 9, a discharge cell, which has once transitioned to the non-light emitting state by the selective erasure discharge, will not transition again to the "light emitting cell" state within the same field. Therefore, there exists no light emission pattern which presents inversion of a discharge cell from a light emission period to a non-light emission period and vice versa in one field period, as shown in FIG. 1, so that the spurious border is suppressed.

When the gradation driving is performed as shown in FIGS. 10 and 11 using the drive pixel data GD which can take 15 bit patterns as shown in FIG. 9, 15 different sequences of light emission driving are performed in accordance with the respective bit patterns to provide 15 levels of intermediate display luminance as follows:

$$\{0, 1, 4, 9, 17, 27, 40, 56, 75, 97, 122, 150, 182, 217, 255\}$$

On the other hand, the pixel data PD generated by the A/D converter 3 has eight bits and hence can represent halftones at 256 levels. As such, the multi-gradation processing circuit 33 illustrated in FIG. 3 performs multi-gradation processing for virtually realizing a halftone display at 256 luminance levels even with the 15-level gradation driving.

Further, in the present invention, the writing discharge for initialization is inhibited for discharge cells which display luminance level "0," i.e., those which serve for black display in the selective initialization process SRc. Consequently, since any discharge does not occur to cause the light emission in the discharge cells serving for black display, the contrast for the black display is improved.

In the foregoing embodiment, the pixel data writing process Wc is performed in the first subfield SF1. However, since discharge cells serving for luminance levels other than luminance level "0" are driven to emit light without fail in the light emission sustain process Ic of the subfield SF1, the pixel data writing process Ic need not be performed purposely in the subfield SF1.

FIG. 12 is a diagram illustrating a light emission driving format which has been created in view of the aspect mentioned above. FIG. 13 is a waveform chart showing a variety of driving pulses applied by each of the address driver 6, first sustain driver 7 and second sustain driver 8 to the column electrodes and the row electrode pairs of the PDP 10 in accordance with the light emission driving format of FIG. 12, and timings at which the driving pulses are applied.

In the light emission driving format illustrated in FIG. 12, the light emission sustain process Ic is performed in each subfield, while the pixel data writing process Wc is performed in each of the remaining subfields except for the first subfield SF1. Then, a selective initialization process SRc' is performed only in the first subfield SF1, while the erasure process E is performed only in the last subfield SF14.

In the gradation driving shown in FIGS. 12 and 13, the operation in each of the remaining subfields SF2–SF14 except for the subfield SF1 is identical to that shown in FIGS. 10 and 11. Therefore, the following description will be made only on the operation in the subfield SF1.

As shown in FIG. 13, in the selective initialization process SRc', the address driver 6 generates an initialization data pulse having a pulse voltage corresponding to each of initialization data bits $RDB_{11}$–$RDB_{nm}$ read from the memory 4. In this event, as described above, the initialization data bit RDB indicates a logical level at the zero-th bit of the drive pixel data GD shown in FIG. 9. For example, the address driver 6 generates the initialization data pulse at a high voltage when the initialization data bit RDB is at logical level "1" and at a low voltage when the initialization data bit RDB is at logical level "0." Then, the address driver 6 groups the initialization data pulses for every display line into initialization data pulse groups $RDP_1$–$RDP_n$ which are sequentially applied to the column electrodes $D_1$–$D_m$ of the PDP 10, as shown in FIG. 13. Further, in the selective initialization process SRc', the second sustain driver 8 generates a scanning pulse $SP_W$ of negative polarity at the same timing at which each of the initialization data pulse groups $RDP_1$–$RDP_n$ is applied, and sequentially applies the scanning pulse $SP_W$ to the row electrodes $Y_1$–$Y_n$.

In this event, a writing discharge is produced only in discharge cells at intersections of display lines applied with the scanning pulse $SP_W$ with "columns" applied with the initialization data pulse at the high voltage, and charged particles are generated within the discharge space of each discharge cell. Then, after the end of the writing discharge, wall charges are formed in the discharge cells, so that the discharge cells are initialized to a "light emitting cell" state. On the other hand, the writing discharge as described above is not produced in discharge cells which have been applied with the initialization data pulse at the low voltage even with the scanning pulse $SP_W$ applied thereto. Therefore, no wall charges are formed in these discharge cells, causing the discharge cells to remain in a "non-light emitting cell" state.

Here, whether or not the writing discharge is produced depends on the logical level of the zero-th bit of the drive pixel data GD shown in FIG. 9. The zero-th bit of the drive pixel data GD is at logical level "0" when the multi-gradation processed pixel data $PD_S$ is "0000," i.e., indicative of a luminance level "0" and at logical level "1" when $PD_S$ indicates a luminance level other than the luminance level "0." Then, the writing discharge is produced as long as the zero-th bit of the drive pixel data GD is at logical level "1," while any discharge is not produced when the zero-th bit is at logical level "0."

Therefore, with the selective initialization process SRc' thus performed, the wall charge resulting from the writing discharge is produced in each of discharge cells corresponding to pixel data indicative of luminance levels other than luminance level "0" so that the discharge cells are initialized to the "light emitting cell" state. On the other hand, since no discharge occurs in each of discharge cells corresponding to pixel data indicative of luminance level "0," the wall charge as described is not either formed, so that these discharge cells remains in the "non-light emitting cell" state. In other words, since discharge cells need not be driven to emit light in the black display in which the luminance level is at "0," the writing discharge for the initialization to the "light emitting cell" state is not produced in these discharge cells.

After the selective initialization process SRc' is performed, the light emission sustain process Ic is immediately performed in the subfield SF1 without performing the pixel data writing process Wc. It should be noted that since the pixel data writing process Wc is not performed, the first bit of the drive pixel data GD shown in FIG. 9 is not used. With the light emission sustain process Ic in the subfield SF1, only discharge cells which have been initialized to the "light emitting cell" state in the selective initialization process SRc' discharge for sustaining light emission each time they are applied alternately with the sustain pulses $IP_X$, $IP_Y$ as shown in FIG. 13 to repeat light emission resulting from the discharges.

As described above, in the subfield SF1 in the gradation driving shown in FIGS. 12 and 13, the selective initialization process SRc' is followed by the light emission sustain process Ic without performing the pixel data writing process Wc, thereby resulting in a reduction in a time spent for performing the subfield SF1, as compared with the driving shown in FIGS. 10 and 11. Therefore, when the number of light emissions performed in the light emission sustain process Ic of each subfield SF1–SF14 is increased by the reduction in time, a higher luminance display can be accomplished. Alternatively, when the number of subfields in one field display period is increased by the reduction in time, the number of gradation luminance levels is also increased, thereby making it possible to improve the quality of displayed images.

It should be noted that with the gradation driving shown in the foregoing embodiment, the number of times the sustain discharge is performed is reduced if a video signal corresponding to an image at a low luminance level is supplied in succession, so that the priming effect in each discharge cell becomes lower to cause difficulties in successfully producing the discharge. In other words, the selective writing discharge in the selective initialization process SRc (SRc') and the selective erasure discharge in the pixel data writing process Ec become instable.

To solve this problem, a priming process is provided immediately before the selective initialization process SRc (SRc') for producing a priming discharge, thereby ensuring the production of the selective writing discharge in the selective initialization process SRc (SRc'). In this event, the priming discharge is produced by applying the row electrodes with a priming pulse PP of positive polarity, for example, as shown in FIG. 11.

Alternatively, the pixel data writing operation may be ensured by again forcing discharge cells, which have been subjected to the selective erasure discharge in the pixel data writing process Wc of any of the subfields, to produce the selective erasure discharge in the pixel data writing process Wc of the next subfield. In this event, the second data converter circuit 34 employs a data conversion table as shown in FIG. 14. Thus, according to the drive pixel data GD which are converted based on this data conversion table, the selective erasure discharge is successively performed in the pixel data writing process Wc of each of two successive subfields, as indicated by black circles in FIG. 14. With such an operation, even if wall charges in discharge cells cannot be normally erased by the first selective erasure discharge, the wall charges can be erased by the second selective erasure discharge, so that the pixel data writing operation is carried out without fail.

As described above in detail, in the present invention, the writing discharge is selectively produced only in discharge cells except for those serving for luminance level "0" on a plasma display panel only in the first subfield, to initialize these discharge cells to a light emitting cell state. Then, the erasure discharge is selectively produced in the discharge cells remaining in the light emitting cell process only in any one of the remaining subfields except for the first subfield in accordance with pixel data, causing the discharge cells to transition to a non-light emitting cell state. Further, in each subfield, only the discharge cells remaining in the light emitting cell state are caused to emit light the number of light emissions allocated thereto corresponding to a weighting factor applied to the subfield.

Consequently, there exists no light emission pattern which presents the inversion of a discharge cell from a light emission period to a non-light emission period and vice versa in one field period, so that the spurious border is suppressed. Further, in the present invention, discharge cells serving to display luminance level "0" (black display) are not initialized, i.e., no wall charge is formed therein. Therefore, according to the present invention, since any discharge (causing light emission) is not produced for forming the wall charge in discharge cells serving for black display, the contrast is improved in black display region.

This application is based on Japanese Patent Application No. 2000-127727 which is hereby incorporated by reference.

What is claimed is:

1. A method of driving a plasma display panel to display in gradation representation in accordance with a video signal, said plasma display panel having discharge cells, functioning as pixels, at intersections of a plurality of row electrodes corresponding to display lines with a plurality of column electrodes arranged to intersect said row electrodes, said method comprising the steps of:

selectively producing a writing discharge only in discharge cells except for discharge cells serving to display a luminance level "0" only in a first subfield of a plurality of subfields constituting one field display period in said video signal to initialize said discharge cells to a light emitting cell state;

selectively producing an erasure discharge in said discharge cells remaining in said light emitting cell state in accordance with pixel data corresponding to said video signal only in one of the remaining subfields except for said first subfield to have said discharge cells transition to a non-light emitting cell state; and driving only said discharge cells in said light emitting cell state to emit light in each of said subfields a number of light emissions allocated thereto corresponding to a weighting factor applied to each of said subfields.

2. A plasma display panel driving method according to claim 1, further comprising the step of producing a priming discharge in each of said discharge cells remaining in said light emitting cell state immediately before said writing discharge.

3. A method of driving a plasma display panel to display in gradation representation in accordance with a video signal, said plasma display panel having discharge cells, functioning as pixels, at intersections of a plurality of row electrodes corresponding to display lines with a plurality of column electrodes arranged to intersect said row electrodes, said method comprising the steps of:

segregating discharge cells serving to display a luminance level "0" among said discharge cells;

selectively producing a writing discharge only in discharge cells except for said discharge cells serving to display a luminance level "0" only in a first subfield of a plurality of subfields constituting one field display period in said video signal to initialize said discharge cells to a light emitting cell state;

selectively producing an erasure discharge in said discharge cells remaining in said light emitting cell state in accordance with pixel data corresponding to said video signal only in one of the remaining subfields except for said first subfield to have said discharge cells transition to a non-light emitting cell state; and driving only said discharge cells in said light emitting cell state to emit light in each of said subfields a number of light emissions allocated thereto corresponding to a weighting factor applied to each of said subfields.

4. A plasma display panel driving method according to claim 3, further comprising the step of producing a priming discharge in each of said discharge cells remaining in said light emitting cell state immediately before said writing discharge.

* * * * *